US008280006B2

(12) United States Patent
Takeuchi et al.

(10) Patent No.: US 8,280,006 B2
(45) Date of Patent: Oct. 2, 2012

(54) X-RAY TUBE

(75) Inventors: Ryozo Takeuchi, Hitachi (JP); Hiroshi Morita, Mito (JP); Yoshitaka Seki, Mobara (JP); Yoshiaki Tsumuraya, Mobara (JP)

(73) Assignee: Hitachi Medical Corporation, Tokyo (JP)

( * ) Notice: Subject to any disclaimer, the term of this patent is extended or adjusted under 35 U.S.C. 154(b) by 193 days.

(21) Appl. No.: 12/602,177

(22) PCT Filed: May 21, 2008

(86) PCT No.: PCT/JP2008/059309

§ 371 (c)(1),
(2), (4) Date: May 28, 2010

(87) PCT Pub. No.: WO2008/146668

PCT Pub. Date: Dec. 4, 2008

(65) Prior Publication Data

US 2010/0239071 A1 Sep. 23, 2010

(30) Foreign Application Priority Data

May 31, 2007 (JP) ..... 2007-144348

(51) Int. Cl.
*H01J 35/00* (2006.01)

(52) U.S. Cl. ..... 378/121

(58) Field of Classification Search ..... 378/119, 378/121, 123

See application file for complete search history.

(56) References Cited

U.S. PATENT DOCUMENTS 3,725,718 A * 4/1973 Quirk et al. ..... 313/313
2006/0002516 A1 1/2006 Takeuchi et al.

FOREIGN PATENT DOCUMENTS

| | | |
|---|---|---|
| JP | 54-102888 | 8/1979 |
| JP | 07-326281 | 12/1995 |
| JP | 2003-203591 | 7/2003 |
| JP | 2006-019223 | 1/2006 |

OTHER PUBLICATIONS

Notification of Transmittal of Translation of the International Preliminary Report of International Appln. No. PCT/JP2008/059309 dated Jan. 21, 2010.

* cited by examiner

*Primary Examiner* — Irakli Kiknadze
(74) *Attorney, Agent, or Firm* — Antonelli, Terry, Stout & Kraus, LLP.

(57) ABSTRACT

The present invention provides an X-ray tube that improves and stabilizes a withstanding voltage performance and thus ensures the reliability of a product.

The present invention is an X-ray tube comprising a cathode for emitting electrons, an anode for emitting an X-ray which an irradiation of the electrons emitted from the cathode causes, and a glass tube for confining the cathode and the anode in a vacuum, wherein an inside surface of the glass tube is covered with a glass thin film having a melting point lower than that of a glass of the glass tube and particles adhered to the glass tube by the glass thin film.

13 Claims, 6 Drawing Sheets

X-RAY TUBE

TECHNICAL FIELD

The present invention relates to an X-ray tube that is downsized, has no unevenness among products in a withstanding voltage performance, and is stabilized.

BACKGROUND ART

A conventional X-ray tube is configured so as to envelope a vacuum tube structure with an insulating oil and, vacuum at a vacuum section is maintained with a glass tube, and a cathode for emitting electrons is insulated from an anode for emitting an X-ray which irradiation of the electrons causes by the vacuum and the glass. A portion where dielectric strength is low in the configuration is an interface between the glass and the vacuum. A gas component may be adsorbed to the portion in some cases and the insulation performance considerably deteriorates if electrically conductive dust remains in the glass tube by mistake during a manufacturing process. An inside surface of the glass is mirror-finished and fully cleaned with a, solvent or the like in order to remove such contaminants, further a voltage obtained by restricting electric current with a high resistance is applied while the gas is evacuated from the glass tube, and the withstanding voltage performance is improved gradually. This process is called conditioning. By this process, the state of the withstanding voltage performance necessary for the vacuum section and the inside surface of the glass tube is obtained. The insulation of the X-ray tube is ensured by filling an exterior of the glass tube with the insulating oil in the state. However, some tubes happen to have an inferior insulation performance in rare cases and further improvement of the insulation performance is desired. In the case of a conventional X-ray tube, as shown in Patent Citation 1 (Japanese Patent Laid-open No. 2003-203591) and Patent Citation 2 (Japanese Patent Laid-open No. 2006-19223), it is attempted to improve insulation performance by homogenizing resistance at a cathode support section; forming a metal film on an inside surface of the glass tube; or roughening the inside surface of the glass tube by shot-blasting and thereby forming dents of several microns.

Patent Citation 1: Japanese Patent Laid-open No. 2003-203591

Patent Citation 2: Japanese Patent Laid-open No. 2006-19223

DISCLOSURE OF INVENTION

Technical Problem

Various technologies are used for further improving the insulation performance of an X-ray tube. However, in the case of the configuration of homogenizing the resistance of a cathode support section, it is necessary to form the cathode support section into a simple shape and moreover an electric current flowing in the resistance causes a loss during operation. Further, in case that a metal film is formed on the inside surface of the glass tube, an electric current flows in the metal film part to cause a loss during operation. Meanwhile, in case that the inside surface of the glass tube is roughened by shot-blasting, there is a risk of causing microcracks in glass due to an impact of the roughening and a treatment process such as hydrofluoric acid cleaning has to be added in order to thoroughly remove the roughened glass.

An object of the present invention is to stably improve the insulation performance of the X-ray tube to solve the above problems without changing the dimension of the X-ray tube.

Technical Solution

The object of the present invention is attained by adhering particles to an inside surface of an X-ray tube in order to further improve the insulation performance in a stable manner. We have experimentally found that the insulation performance of an inside surface of a glass tube improves by adhering particles having several microns in particle diameter to the inside surface of the glass tube on a cathode side. The effect is stable and an unstable state in a conventional technology can be avoided.

Advantageous Effects

The present invention makes it possible to improve a withstanding voltage performance to about 1.5 times or more even when the dimension of an X-ray tube is unchanged from a conventional one. The effect is stable and the service life of the X-ray tube can be prolonged considerably.

EXPLANATION OF REFERENCE

Figure 1:
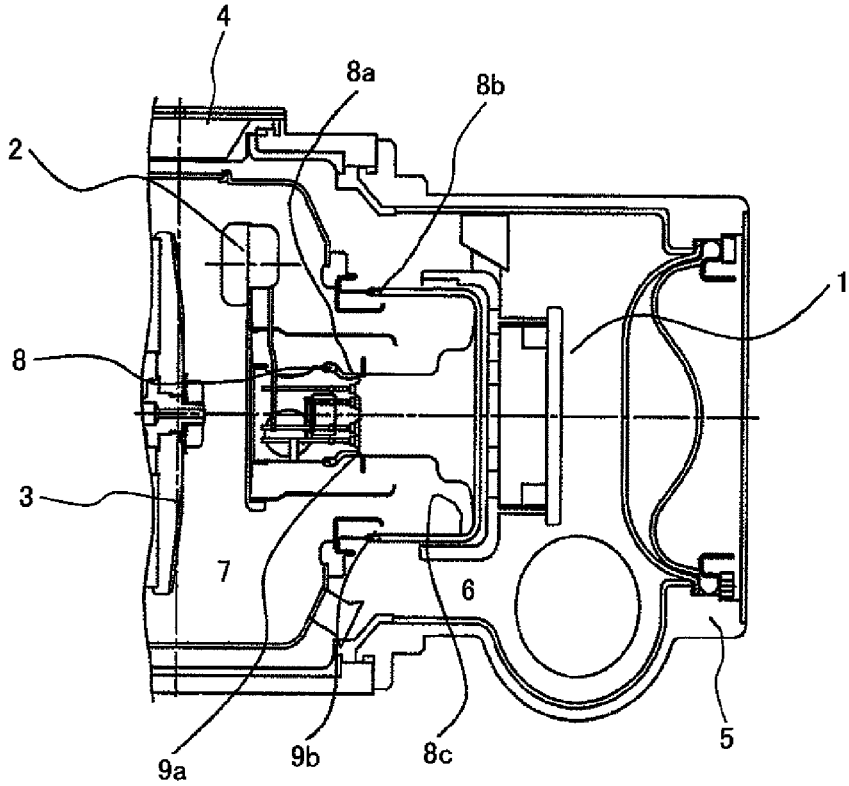
FIG. 1 is a sectional view showing a part of an X-ray tube according to the present invention.

1 X-ray tube
2 Cathode
3 Target
4 Glass window
5 Case
6 Insulating oil
7 Vacuum
8 Stem
8*a* Cathode side metal edge
8*b* Ground potential side metal edge
8*c* Inside surface of glass tube
9 Particle
9*a* Particle cathode end
9*b* Particle intermediate potential end
10 Glass tube
11 Cathode side end
12 Anode side end

BEST MODE FOR CARRYING OUT THE INVENTION

Figure 2:
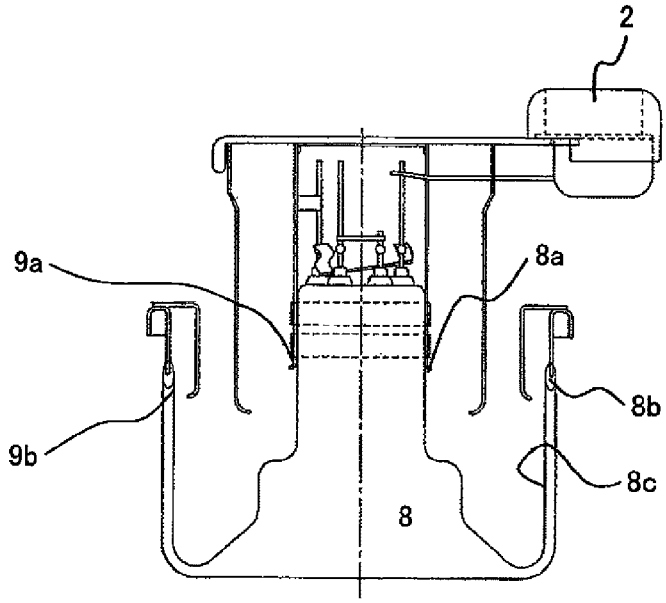
FIG. 2 is a sectional view showing a stem of the X-ray tube according to the present invention.
Figure 3:
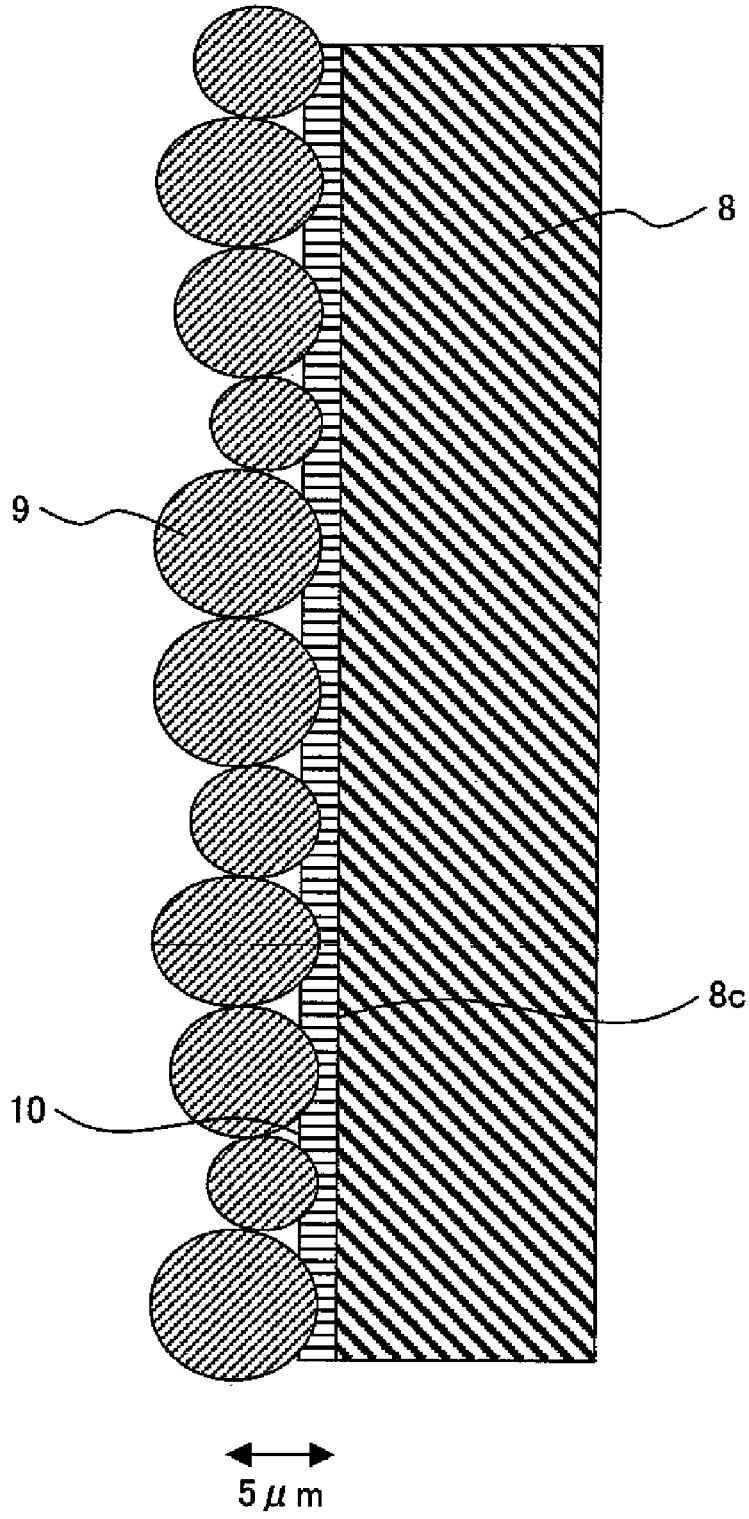
FIG. 3 is a sectional view showing the stem of the X-ray tube according to the present invention.
Figure 4:
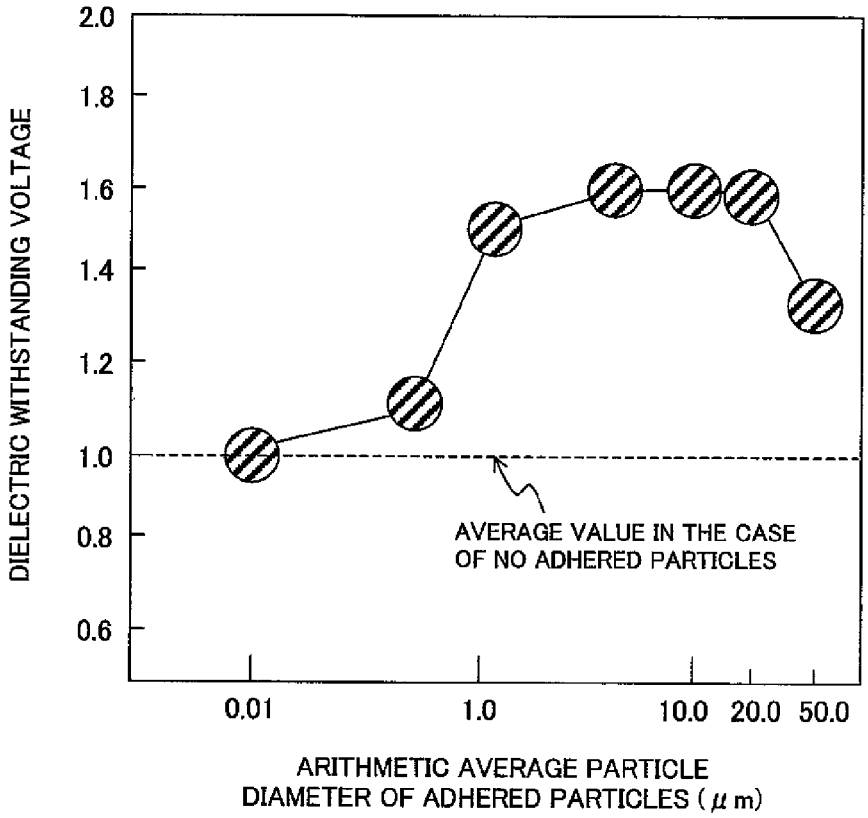
FIG. 4 is a graph showing the relationship between a diameter of an adhered particle and a withstanding voltage performance.

A substantial part of an X-ray tube according to the present invention is shown in FIG. 1. An example of the withstanding voltage performance of an X-ray tube is a high voltage of about 200 kV. Electrons are emitted from a cathode 2 of an X-ray tube 1, a target 3 of an anode is irradiated with the electrons, and an X-ray generated from the target 3 is extracted through a glass window 4. The substantial section is kept in the state of a vacuum and a stem 8 for supporting the cathode is important from the viewpoint of insulation. An exterior of the stem 8 is filled with an insulating oil 6 and a stable insulation performance is exhibited by controlling dust or the like in the oil. All the components are contained in a case 5. Here the withstanding voltage performance improves considerably by adhering particles 9 to a inside surface of the glass tube 8*c* ranging from a cathode side metal edge 8*a* to a ground potential side metal edge 8*b* on a side of a vacuum 7 of the stem 8 and thus forming protrusions of several microns between a particle cathode end 9*a* and a particle intermediate potential end 9*b*. The stem section is shown in FIG. 2. The insulation performance improves considerably by adhering the particles 9 of several microns to the inside surface of the glass tube 8*c* ranging from the cathode side metal edge 8*a* to the ground potential side metal edge 8*b* of the stem 8. An appearance of the particles 9 adhered to the inside surface of the glass tube 8*c* is shown in FIG. 3. The particles 9 represent a case where an arithmetic average particle diameter is 5 μm. Particle diameters are obtained by measuring the distribution with sieves having prescribed meshes or measuring visually with a microscope and in this case the diameters are obtained by particle-sizing with sieves. A low-melting glass 10 is formed by heating and solidifying glass frit paste used when the inside surface of the glass tube 8*c* is coated with particles 9. The particles 9 are adhered to the inside surface of the glass tube 8*c* by the low-melting glass 10. The relationship between the diameter of particles adhered to an inside surface of the glass tube and a withstanding voltage is shown in FIG. 4. In case that particles having a particle diameter of 1 to 20 μm adhere, about 1.5 times or more of withstanding voltage performance is obtained than the case where no particles are adhered. Here, if a particle diameter is too large, it is estimated that the electric field concentration increases at the particles and the withstanding voltage performance deteriorates.

Figure 5:
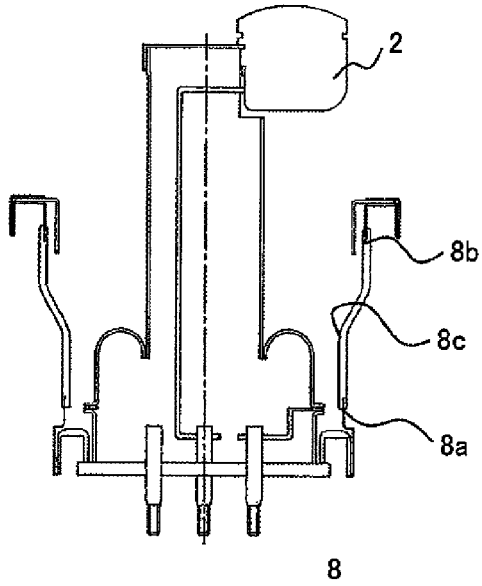
FIG. 5 is a sectional view showing a stem according to another embodiment of the present invention.

A substantial part of an X-ray tube according to another embodiment is shown in FIG. 5. A stem 8 comprises a plurality of members and it is a inside surface of the glass tube 8*c* ranging from a cathode side metal edge 8*a* to a ground potential side metal edge 8*b* to play a role of insulation. The withstanding voltage performance improves considerably by adhering the particles of several micrometers to the inside surface of the glass tube 8*c*.

In order to adhere the particles of several micrometers to the inside surface of the glass tube 8*c*, the following glass frit paste is used:

The glass frit paste is produced by dissolving low-melting glass frit pulverized to particle diameters of submicron in a mixture of methyl cellulose, ethyl cellulose, carboxymethyl cellulose, oxyethyl cellulose, benzyl cellulose, propyl cellulose, nitrocellulose or the like that is called vehicle and a solvent such as terpineol, butyl carbitol acetate or ethyl carbitol acetate, or a mixture of acrylic resin such as methyl acrylate, ethyl acrylate, butyl acrylate or 2-hydroxyethylmethacrylate and a solvent such as methyl ethyl ketone, terpineol, butyl carbitol acetate or ethyl carbitol acetate. The particles of several microns are mixed with the glass frit paste and the inside surface of the glass tube 8*c* is coated with the mixture in a fluidized state. Otherwise, it is also possible to lower the viscosity by increasing the amount of a solvent and spray the mixture with an air gun. Successively, heat is applied while the glass tube is rotated around the center axis of the cylindrical glass. When the temperature reaches 150° C. to 200° C., the organic solvent is vaporized by the heat and the resin component called vehicle is hardened. The particles of several microns thereby are adhered to the inside surface of the glass tube 8*c* by the fine glass frit and the resin. Further, when the temperature exceeds 400° C., the glass frit melts and the resin component is pyrolytically decomposed and disappears. When the temperature of the glass is lowered from the temperature, the particles are firmly adhered to the inside surface of the glass tube 8*c* by the low-melting glass formed by melting and solidifying the glass frit again. If the cooling process is hurried, the low-melting glass may be separated from the cylindrical glass in some cases and at least two hours has to be spent for the cooling process. By doing so, the particles of several microns can be adhered to the inside surface of the glass tube 8*c*. As the low-melting glass, glass containing lead has been mostly used but in recent years bismuth glass, phosphate glass and vanadium glass are also used.

The melting point of these glasses can be selected in the range of 320° C. to 500° C. Further, as the particles, zircon, cordierite, aluminum titanate, alumina, mullite, silica, tin oxide ceramics or molten silica can be used individually or in combination. The particles are mixed with the glass frit paste and used, and the mixing ratio of the particles is determined in accordance with a viscosity of the glass frit paste. The purpose is to obtain a viscosity that allows the inside surface of the glass tube 8*c* to be coated with the glass frit paste containing the particles and the viscosity is confirmed by brush coating or the like. When the particles are sprayed with an air gun, the viscosity has to be lowered further.

Figure 6:
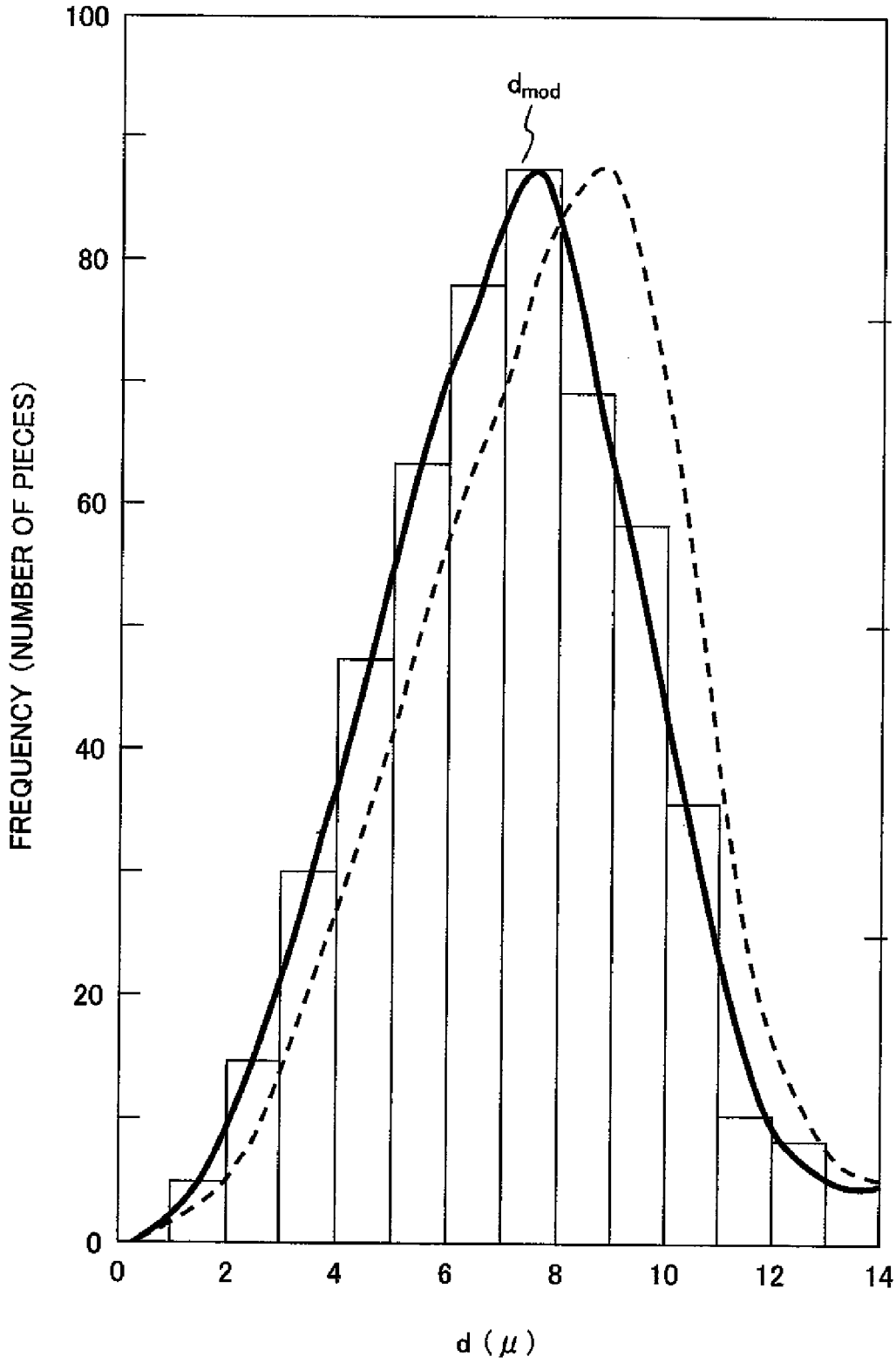
FIG. 6 is a graph showing a distribution of the diameters of the adhered particles.

The diameter and shape of the particles are important in order to form protrusions of several microns on the inside surface of the glass tube. As the shape, a spherical shape is desirable, but since large blocks are pulverized, a perfect sphere is hardly obtained and it is desirable that the shape is as spherical as possible. The flatness of a particle shape can be defined as an aspect ratio and a desirable aspect ratio is 3 or less. A more desirable aspect ratio is 2 or less. An example of the particle size distribution selected with sieves is shown in FIG. 6. By narrowing the distribution width of the particle diameters, it is possible to further stabilize the insulation performance. An effective particle diameter range is 1 to 20 μm, and preferably 2 to 10 μm. The particle diameter distribution can be selected as shown in FIG. 6 by selecting the upper limit mesh and the lower limit mesh of the sieves.

A part where protrusions are not desired to be formed by the adhesion of the particles is covered by attaching a tape formed of polyvinyl chloride or the like so that asperities may not be formed. In particular, even in the case where the particles are adhered only to a range of 5 mm in width from the cathode side metal edge 8*a* on the inside surface of the glass tube 8*c* in the example shown in FIG. 5, the same effect as the case where the particles are adhered to the whole surface is obtained.

Figure 7:
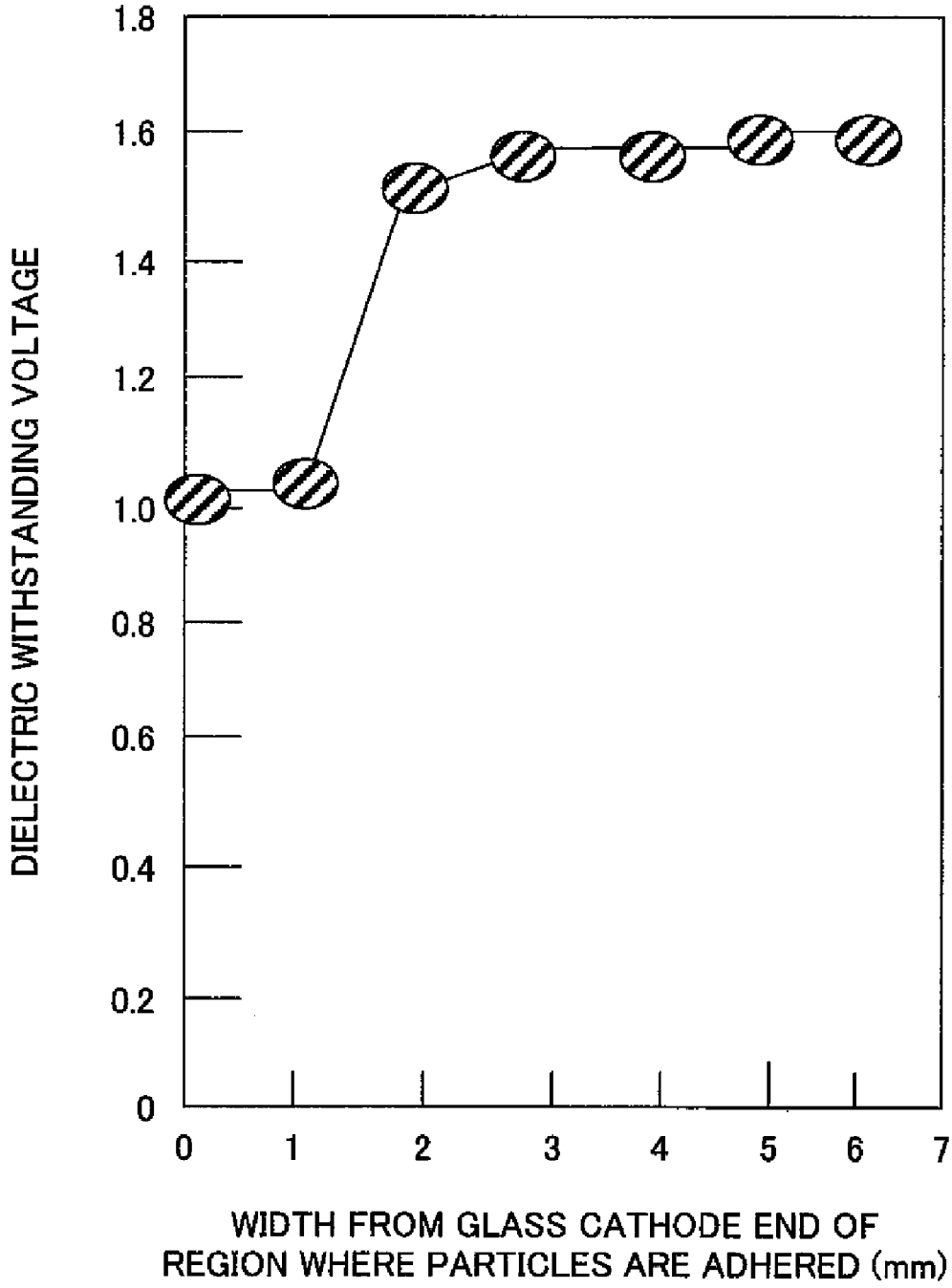
FIG. 7 is a graph showing a relationship between a width of a region where particles are adhered to an inside surface of the glass tube interposed between an anode and a cathode, and the withstanding voltage performance.

A result of an experiment for determining an effective width of an inside surface of the glass tube to which the particles are adhered is shown in FIG. 7. In the experiment, the particles are adhered to a range of a prescribed width from the cathode side metal edge of the glass tube. It is obvious that the effect appears when the particles are adhered to a range of 2 mm or more in width from the cathode side metal edge.

Although a base point of the width of the adhered particles is set at the cathode side metal edge of a glass tube in the experiment, the base point is not limited to the location and it is confirmed that a similar effect appears even when the base point is set at a position different from the cathode side metal edge of the glass tube and the particles are adhered to a inside surface of the glass tube between the anode and the cathode in width of 2 mm or more.

Figure 8:
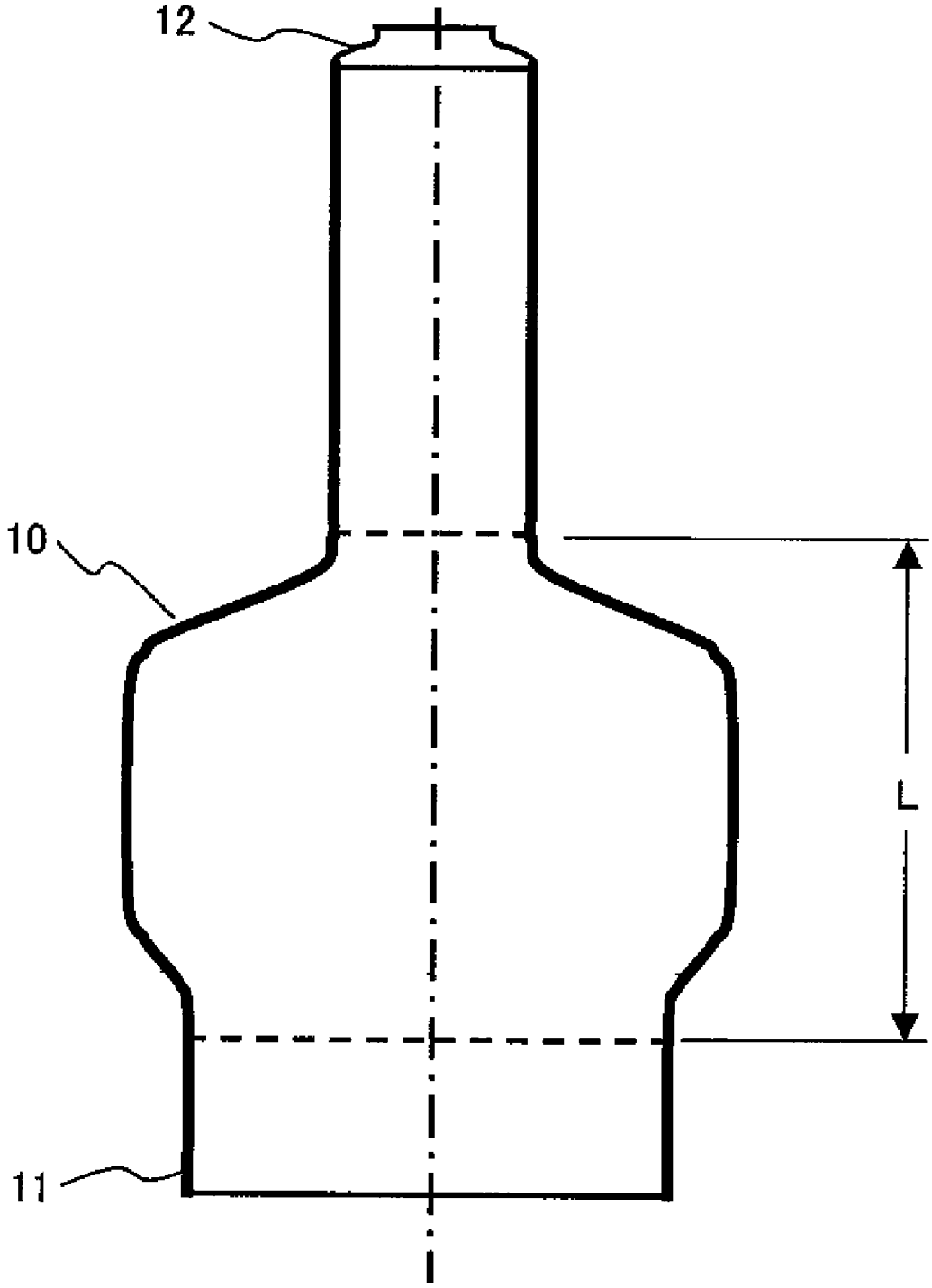
FIG. 8 is a front view showing a range where the particles are adhered to an X-ray tube glass.

A glass tube 10 for an X-ray tube before a cathode 2 and a stem 8 are connected is shown in FIG. 8. The cathode 2 and the stem 8 (those not being shown in the figure) are joined to a tip of a cathode side end 11 of the glass tube 10 by partially melting the glass on both sides. A rotary anode is inserted from the anode side end 12 of the glass tube 10 and the glass tube is sealed. Prior to the work, the particles are adhered to the inside surface of the glass tube 10. The effect is confirmed by setting a region represented by the reference symbol L in the figure as an adhesion range (coating is applied to the width of about 100 mm and an X-ray emission portion is covered with the tape formed of polyvinyl chloride and not coated with particles). As a result, 1.5 times or more withstanding voltage performance is obtained than the withstanding voltage performance in case of no adhered particles. On this occasion, although a particle-coated surface touches neither the cathode nor the anode, the effect is exhibited.

INDUSTRIAL APPLICABILITY

The present invention can be used for producing an X-ray tube having no unevenness in a withstanding voltage performance.

The invention claimed is:

1. An X-ray tube comprising:

a cathode for emitting electrons;

an anode for emitting an X-ray caused by irradiation of the electrons emitted from the cathode; and a glass tube for containing the cathode and the anode in a vacuum, wherein an inside surface of the glass tube is covered with a glass thin film having a melting point lower than that of a glass of the glass tube and particles adhered to the glass tube by the glass thin film, and wherein a material for the particles is at least one selected from the group consisting of zircon, cordierite, aluminum titanate, alumina, mullite, silica, tin oxide ceramics and molten silica.

2. An X-ray tube according to claim 1, wherein diameters of the particles are in a range of 1 to 20 μm.

3. An X-ray tube according to claim 1, wherein an aspect ratio representing a flatness of the particles is 3 or less.

4. An X-ray tube according to claim 1, wherein the particles are adhered to an inside surface of the glass tube between the anode and the cathode in a width of 2 mm or more.

5. An X-ray tube comprising:

a cathode configured to emit electrons;

an anode configured to emit an X-ray when irradiated with the electrons;

a glass tube containing the cathode and the anode in a vacuum;

a glass film formed on an inside surface of the glass tube; and particles adhered to the glass tube by the glass film;

wherein the particles are adhered to the glass tube in a width of 2 mm or more between the anode and the cathode.

6. An X-ray tube according to claim 5, wherein diameters of the particles are in a range of 1 to 20 μm.

7. An X-ray tube according to claim 5, wherein an aspect ratio representing a flatness of the particles is 3 or less.

8. An X-ray tube according to claim 5, wherein a material for the particles is at least one selected from the group consisting of zircon, cordierite, aluminum titanate, alumina, mullite, silica, tin oxide ceramics and molten silica.

9. An X-ray tube according to claim 5, wherein the glass film has a melting point lower than a melting point of a glass of the glass tube.

10. An X-ray tube comprising:

a cathode configured to emit electrons;

an anode configured to emit an X-ray when irradiated with the electrons;

a glass tube containing the cathode and the anode in a vacuum;

a glass film formed on an inside surface of the glass tube; and particles adhered to the glass tube by the glass film;

wherein a material for the particles is at least one selected from the group consisting of zircon, cordierite, aluminum titanate, alumina, mullite, silica, tin oxide ceramics and molten silica.

11. An X-ray tube according to claim 10, wherein diameters of the particles are in a range of 1 to 20 μm.

12. An X-ray tube according to claim 10, wherein an aspect ratio representing a flatness of the particles is 3 or less.

13. An X-ray tube according to claim 10, wherein the glass film is formed from a glass frit having a melting point lower than a melting point of a glass of the glass tube.

* * * * *